US006253900B1

(12) United States Patent
Watanabe

(10) Patent No.: US 6,253,900 B1
(45) Date of Patent: Jul. 3, 2001

(54) COIN SORTING DEVICE, COMMODITY DISCHARGING DEVICE, AND GAME DEVICE

(75) Inventor: Saburo Watanabe, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/502,440

(22) Filed: Feb. 11, 2000

(30) Foreign Application Priority Data

Feb. 25, 1999 (JP) ..... 11-048772

(51) Int. Cl.[7] ..... G07F 5/02; G07F 11/00
(52) U.S. Cl. ..... 194/233; 194/236; 194/255
(58) Field of Search ..... 194/348, 255, 194/233, 236

(56) References Cited

U.S. PATENT DOCUMENTS 5,657,848 * 8/1997 Schwarzli ..... 194/236

* cited by examiner

*Primary Examiner*—Robert P. Olszewski
*Assistant Examiner*—Bryan Jaketic
(74) *Attorney, Agent, or Firm*—Staas & Halsey, LLP

(57) ABSTRACT

The coin sorting device comprises: a body (1); a coin put-in port (4) for putting a coin in; a coin sorting handle (5) which can be rotated; a coin turn table (7) which can be rotated according to a rotation of the coin sorting handle (5) and comprises a coin receiving portion (20) for receiving a put-in coin; a rocking member (21) which can rock around a shaft (21*a*) which is attached to the coin turn table (7), for rocking so that a top end portion of the rocking member (21) is pressed to move in a radial outer direction by a periphery of a normal coin which is received by the coin receiving portion (20); and a stopper (31) which is attached to the body (1), for preventing a rotation of the coin turn table (7) by hitting the top end portion of the rocking member (21) against an end portion (31*a*) of the stopper (31) when a normal coin is not received by the coin receiving portion (20), while for allowing the rotation of the coin turn table (7) without hitting the top end portion of the rocking member (21) which is pressed to move in the radial outer direction, against the end portion (31*a*) of the stopper (31) when a normal coin is received by the coin receiving portion (20).

6 Claims, 6 Drawing Sheets

COIN SORTING DEVICE, COMMODITY DISCHARGING DEVICE, AND GAME DEVICE

BACKGROUND OF THE INVENTION

1. Field of the Invention

The present invention relates to a coin sorting device, a commodity discharging device having the coin sorting device, and a game device having the coin sorting device.

2. Description of Related Art

Conventionally, a coin sorting device for discriminating whether a coin is a normal coin or not on the basis of size, weight, thickness or the like, of the coin to be discriminated, thereby for sorting the discriminated coin, is known.

However, most of such a type of coin sorting device has a complicated structure. Specifically, in the technical field of toy, a coin sorting device which has a simple structure is demanded.

SUMMARY OF THE INVENTION

The present invention was developed in view of the above-described problems.

An object of the present invention is to provide a coin sorting device which has a simple structure and can discriminate whether a coin is a normal coin or not.

Another object of the present invention is to provide a commodity discharging device having the coin sorting device which has a simple structure and can discriminate whether a coin is a normal coin or not, which can discharge a commodity when a put-in coin is normal.

A further object of the present invention is to provide a game device having the coin sorting device which has a simple structure and can discriminate whether a coin is a normal coin or not, which can start a game when a put-in coin is normal.

In accordance with one aspect of the present invention, the coin sorting device comprises: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion.

The normal coin means a coin which has a size possible to be received by the coin receiving portion, and possible to press to move the top end portion of the rocking member in the radial outer direction by the periphery of the coin to allow a rotation of the coin turn table without hitting the top end portion of the rocking member against the end portion of the stopper in a state such a coin of being received by the coin receiving portion.

Therefore, a coin having a periphery possible to move the top end portion of the rocking member in the radial outer direction to an extent without hitting the top end portion of the rocking member against the end portion of the stopper, is discriminated to be a normal coin by the coin sorting device.

Further, a coin having a size as the above-described can be discriminated to be a normal coin by the coin sorting device without being limited to a material of the coin. For example, in a case of coin which is made of material such as plastic or the like which is relatively light, or in a case of coin which is made of a material such as metal or the like which is relatively heavy, a coin having a size as the above-described can be discriminated to be a normal coin by the coin sorting device.

According to the coin sorting device having such a structure, when a normal coin is put in the coin put-in port to be received by the coin receiving portion, the rocking member is rocked so that the top end portion of the rocking member is pressed to move in a radial outer direction by a periphery of the normal coin. Thereby, the top end portion of the rocking member is not hit against the end portion of the stopper so that the stopper does not prevent a rotation of the coin turn table according to a rotation of the coin sorting handle. Therefore, the coin turn table can be rotated. Accordingly, it is possible to provide a coin sorting device which has a simple structure and can easily discriminate whether the put-in coin is a normal coin or not.

Preferably, in the coin sorting device as the above-described, a plurality of coin receiving portions are arranged with approximately the same intervals, along a periphery of the coin turn table and a plurality of rocking members are arranged on the coin turn table according to the coin receiving portions.

According to the coin sorting device having such a structure, it is possible to discriminate whether the put-in coin is a normal coin or not without one rotation of the coin turn table.

Further, the coin sorting device comprises: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the body, for rocking so that a top end portion of the rocking member is pressed to move in a radial outer direction by a periphery of a normal coin which is received by the coin receiving portion; and a stopper which is attached to the coin turn table, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion.

According to the coin sorting device having such a structure, when a normal coin is put in the coin put-in port to be received by the coin receiving portion, the rocking member is rocked so that the top end portion of the rocking member is pressed to move in a radial outer direction by a periphery of the normal coin. Thereby, the top end portion of the rocking member is not hit against the end portion of the stopper so that the stopper does not prevent a rotation of the coin turn table according to a rotation of the coin sorting handle. Therefore, the coin turn table can be rotated. Accordingly, it is possible to provide a coin sorting device which has a simple structure and can easily discriminate whether the put-in coin is a normal coin or not.

Preferably, in the coin sorting device as the above-described, a plurality of coin receiving portions are arranged with approximately the same intervals, along a periphery of the coin turn table and a plurality of stoppers are arranged on the coin turn table according to the coin receiving portions.

According to the coin sorting device having such a structure, it is possible to discriminate whether the put-in coin is a normal coin or not without one rotation of the coin turn table.

Preferably, in the coin sorting device as the described, the rocking member is biased by a biasing member so that the top end portion thereof is biased against a periphery of a normal coin which is received by the coin receiving portion.

According to the coin sorting device, the top end portion of the rocking member is biased against the periphery of the normal coin by the biasing member. Therefore, only when a normal coin is put in the coin put-in port to be received by the coin receiving portion, the top end portion of the rocking member is not hit against the end portion of the stopper. Accordingly, the stopper allows a rotation of the coin turn table so that it is possible to rotate the coin turn table.

In accordance with another aspect of the present invention, the commodity discharging device which can contain many commodities comprises: a coin sorting device comprising: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion, and a structure for discharging a commodity according to a rotation of the coin turn table.

Further, the commodity discharging device which can contain many commodities comprises: a coin sorting device comprising: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the body, for rocking so that a top end portion of the rocking member is pressed to move in a radial outer direction by a periphery of a normal coin which is received by the coin receiving portion; and a stopper which is attached to the coin turn table, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion, and a structure for discharging a commodity according to a rotation of the coin turn table.

According to the commodity discharging device which can contain many commodities, having such a structure, it is possible to discriminate whether the put-in coin which is put in the coin put-in port to be received by the coin receiving portion, is a normal coin or not by the rotation of the coin turn table of the coin sorting device. Therefore, it is possible to discharge a commodity only when the put-in coin is discriminated to be a normal coin by the coin sorting device.

Preferably, the commodity discharging device further comprises a commodity discharging drum for discharging a commodity by rotating with the coin turn table as one.

According to the commodity discharging device, the commodity discharging drum rotates with the coin turn table as one by the rotation of the coin turn table. Therefore, it is possible to provide a commodity discharging device which has a comparative simple structure and can discharge a commodity only when a normal coin is put in the coin put-in port.

Preferably, the commodity discharging device further comprises a agitator member for agitating commodities according to a rotation of the coin turn table.

According to the commodity discharging device, commodities are agitated by the agitator member according to the rotation of the coin turn table so that it is easy to discharge the commodity. When the commodity discharging device contains some different kinds of commodities, it is not possible to guess a commodity to be discharged from the commodity discharging device. Therefore, it is possible to provide a more interesting commodity discharging device.

In accordance with a further aspect of the present invention, the game device comprises: a coin sorting device comprising: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion, wherein the game device can start a game when the coin turn table is rotated.

Further, the game device comprises: a coin sorting device comprising: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the body, for rocking so that a top end portion of the rocking member is pressed to move in a radial outer direction by a periphery of a normal coin which is received by the coin receiving portion; and a stopper which is attached to the coin turn table, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion, wherein the game device can start a game when the coin turn table is rotated.

The game device as the above-described, further may comprise a switch for turning on by a rotation of the coin turn table, to start a game when turning the switch on.

The game device as the above-described, further may comprise a spring for winding by a rotation of the coin turn table, to start a game by a power of the spring.

According to the game device having such a structure, it is possible to discriminate whether a coin is a normal coin or not by the rotation of the coin turn table. Therefore, it is possible to start a game when the put-in coin is discriminated to be a normal coin by the coin sorting device.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Figure 1:
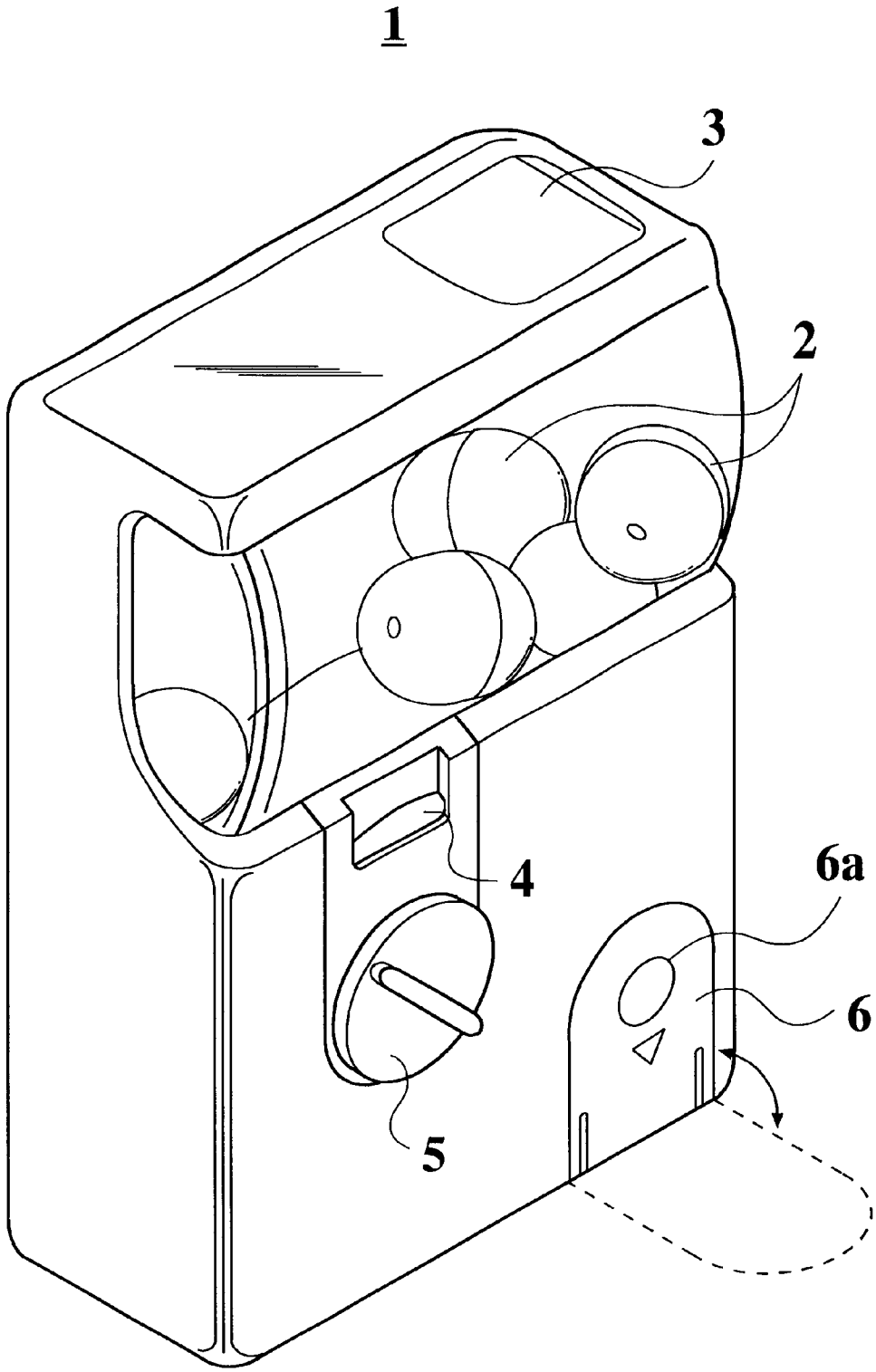
FIG. 1 is a perspective view of an automatic vending machine toy according to an embodiment of a commodity discharging toy of the present invention.

Hereinafter, an embodiment of an automatic vending machine toy as an example of a commodity discharging toy according to the present invention will be explained with reference to the drawing, as follows.

FIG. 1 is a perspective view of the automatic vending machine toy as an example of the commodity discharging toy of the present invention.

In an inside of the automatic vending machine toy 1, a lot of capsule toys 2 which comprises a toy and a capsule containing the toy, as false commodities are contained.

A toy put-in door 3 is provided at an upper side of the automatic vending machine toy 1. The toy put-in door 3 can be opened by sliding in a horizontal direction. When the toy put-in door 3 is opened, it is possible to put the capsule toy 2 in the inside of the automatic vending machine toy 1.

A coin put-in port 4 is provided at a front-side of the automatic vending machine toy 1. For example, a circular coin made of plastic or the like, including a false coin, is put in the coin put-in port 4. In this case, the coin is lightly pushed in the coin put-in port 4, by a finger.

A coin sorting handle 5 and a toy take-out door 6 are provided at the front-side of the automatic vending machine toy 1. When the coin sorting handle 5 is made a half turn in the clockwise direction, one capsule toy 2 is discharged. A toy take-out port on the toy take-out door 6 usually keeps being closed as shown in FIG. 1. However, when a player puts a finger in a hole 6*a* on the toy take-out door 6 and moves the toy take-out door 6 up, as shown with a broken line in FIG. 1, the capsule toy 2 is discharged on the toy take-out door 6.

An internal structure of the automatic vending machine toy 1 will be explained with reference to FIG. 2 to FIG. 4, as follows.

Figure 2:
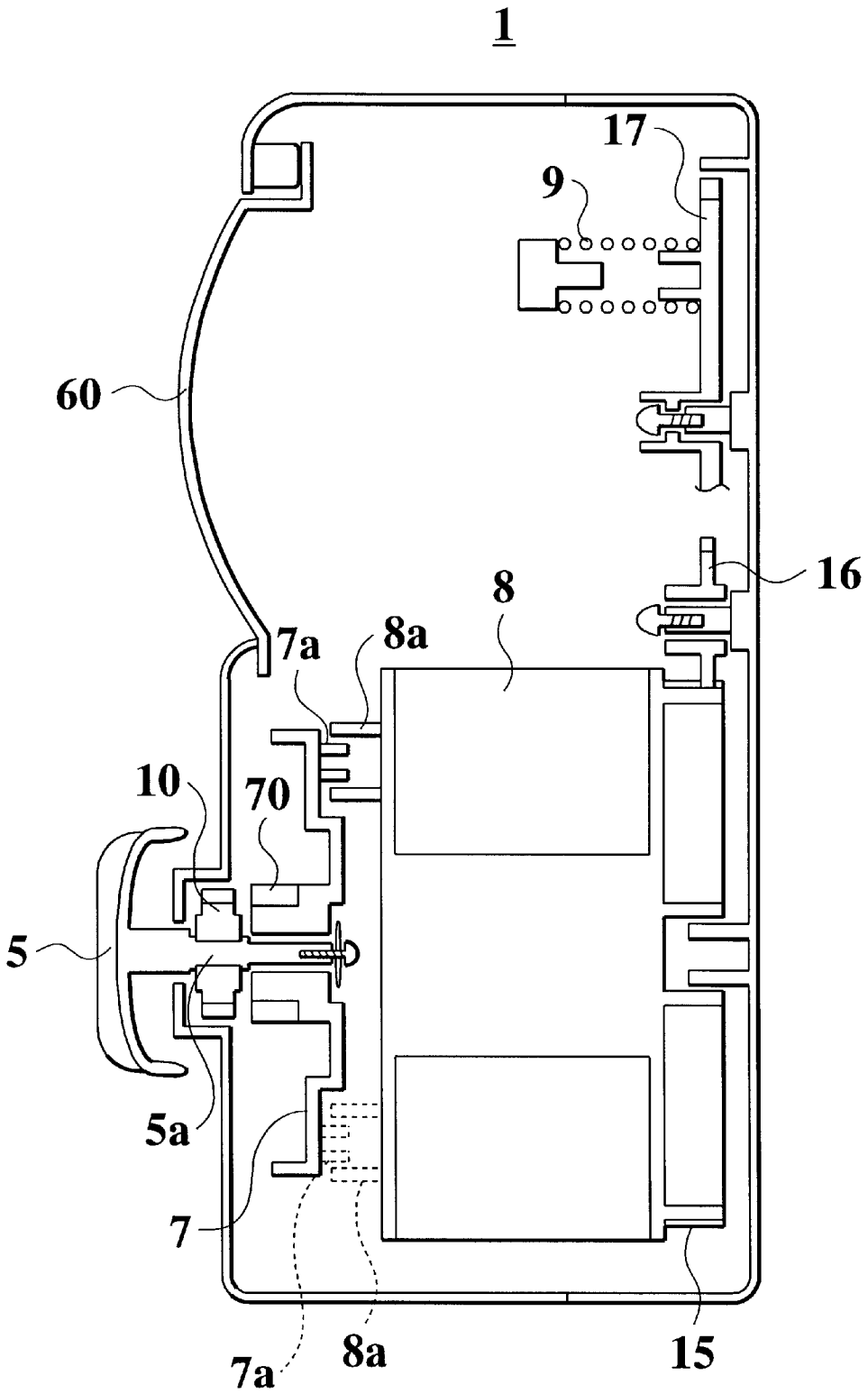
FIG. 2 is a right-side vertical sectional view of the automatic vending machine toy shown in FIG. 1.

FIG. 2 is a right-side vertical sectional view of the automatic vending machine toy 1, as shown in FIG. 1. FIG. 3 is a transverse sectional view of the coin sorting handle 5 and the periphery thereof, of the automatic vending machine toy 1. FIG. 4 is an exploded perspective view of the automatic vending machine toy 1.

The automatic vending machine toy 1 is composed of a handle shaft 5*a* of the coin sorting handle 5, a coin turn table 7, a toy discharging drum 8 having two holes 8*a* and 8 which are provided at a front side of the toy discharging drum 8, two agitator members 9 and 9, a gear 10, a shaft 11, a gear 12, a gear 13, a pushing spring 14, a gear 70, a gear 15, a gear 16, a large gear 17 for agitating capsule toys 2, and so on.

The gear 10 is fixed to the handle shaft 5*a* of the coin sorting handle 5, as shown in FIG. 2.

Figure 3:
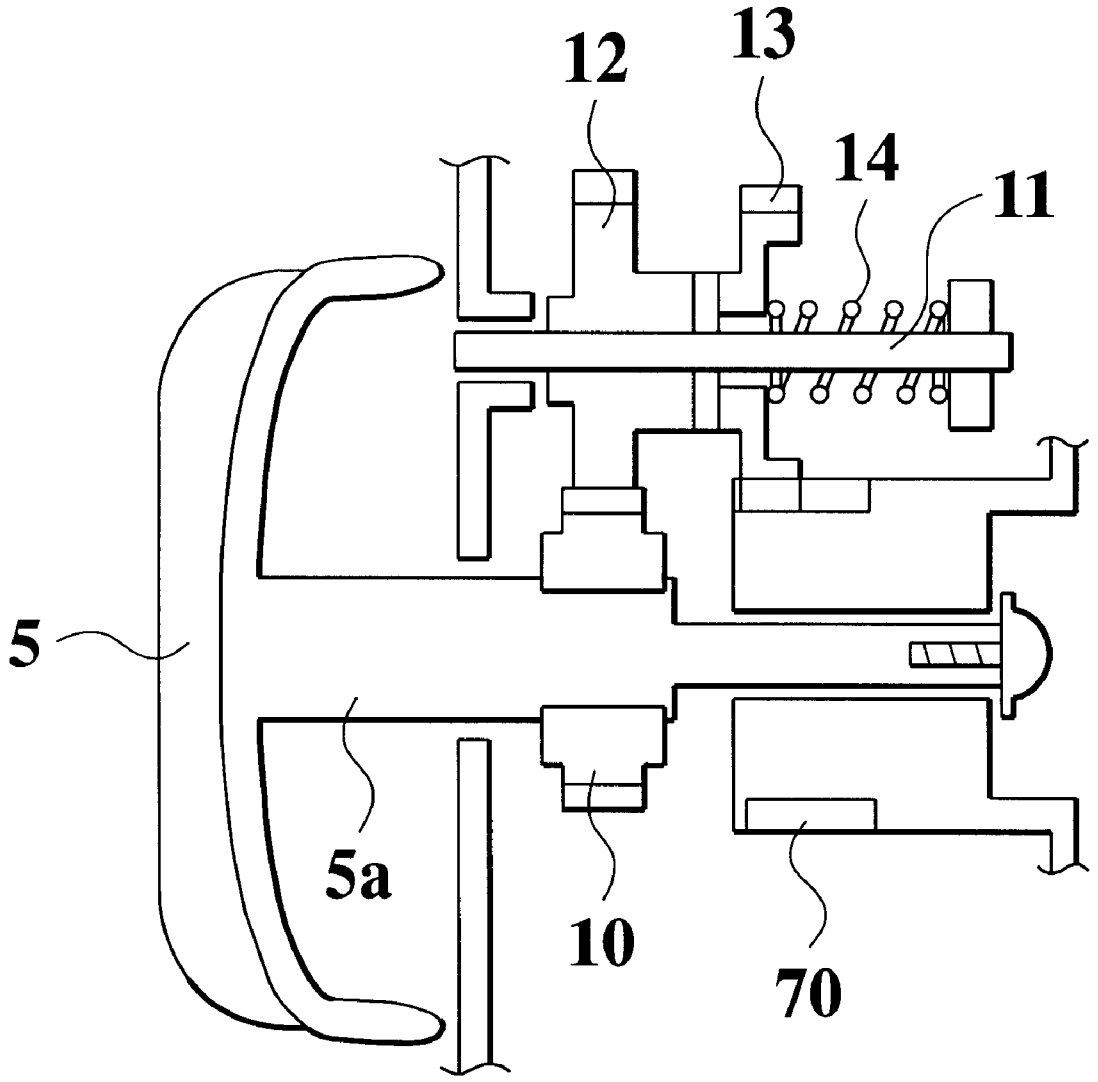
FIG. 3 is a transverse sectional view of a coin sorting handle and the periphery thereof, of the automatic vending machine toy.

The shaft 11 is parallel to the handle shaft 5*a* of the coin sorting handle 5, as shown in FIG. 3.

The gear 12 is fixed to the shaft 11. The gear 12 is engaged with the gear 10, as shown in FIG. 3.

The gear 13 is provided at the shaft 11 in a state of a shaft free. The gear 13 is biased against an end surface of the gear 12 by the pushing spring 14, as shown in FIG. 3. Therefore, when the gear 12 is rotated, the gear 13 is also rotated with the gear 12 at the same time. When something resistant works to the gear 13, the gear 13 is separated from the gear 12 against the biasing power by the pushing spring 14. In this case, the gear 13 does not follow to turn upon the gear 12.

The gear 70 is fixed on the coin turn table 7 and provided at the handle shaft 5*a* of the coin sorting handle 5 in a state of a state free, as shown in FIG. 2. The gear 70 is engaged with the gear 13 as shown in FIG. 3.

Two protruding portions 7*a* and 7*a* are provided at a rear side of the coin turn table 7 as shown in FIG. 2. Two holes 8*a* and 8*a* are provided at a front side of the toy discharging drum 8. Each protruding portion 7*a* of the coin turn table 7 is fitted in each hole 8*a* of the toy discharging drum 8, respectively. Therefore, the toy discharging drum 8 is rotated with the coin turn table 7 as one.

The gear 15 is formed at a periphery on a rear portion of the toy discharging drum 8 as shown in FIG. 2. The gear 15 is engaged with the gear 16 as shown in FIG. 4. Further, the gear 16 is engaged with the large gear 17 for agitating capsule toys 2.

Figure 4:
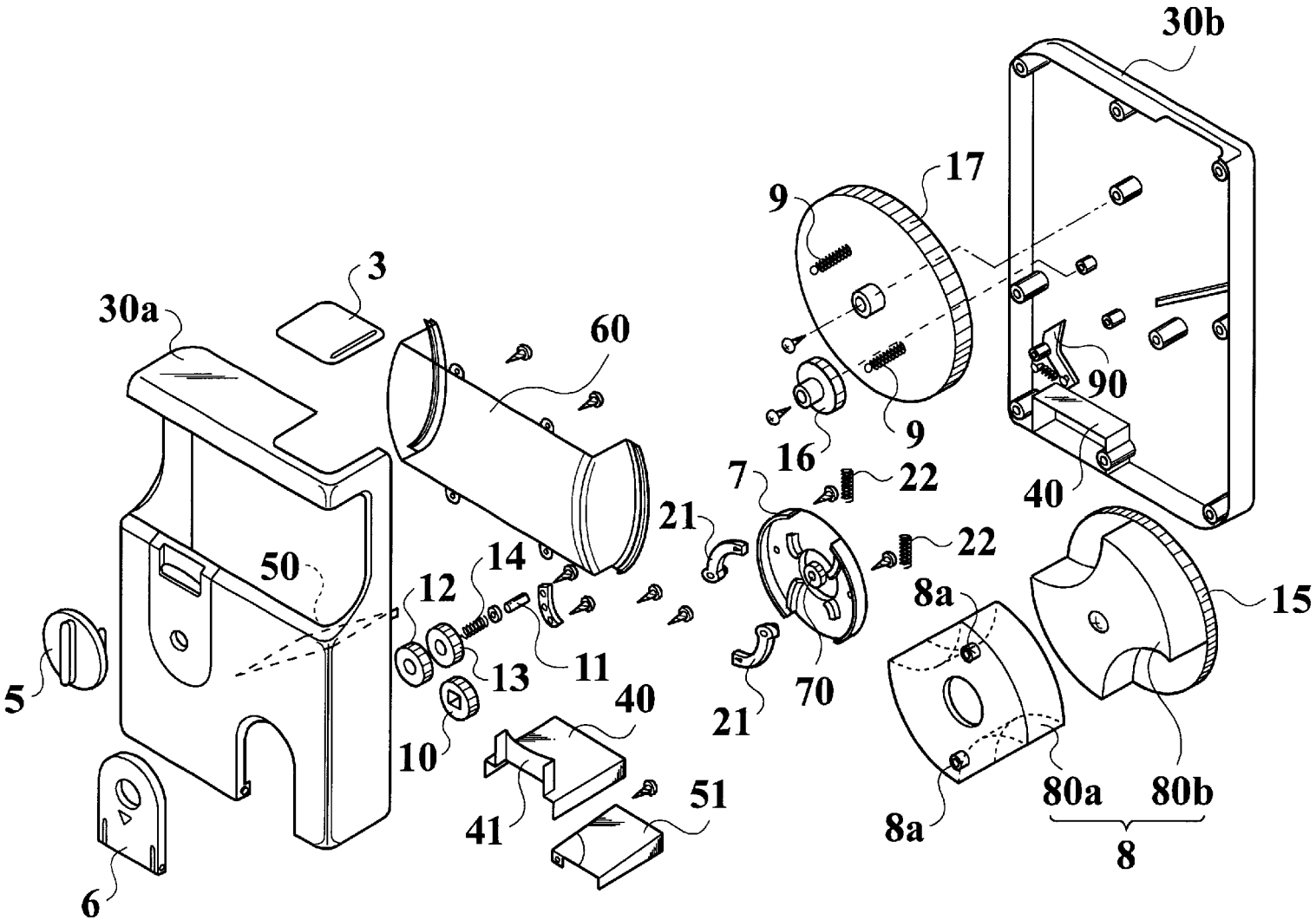
FIG. 4 is an exploded perspective view of the automatic vending machine toy.

Two agitator members 9 and 9 are composed of a pulling spring mainly and provided at a front side surface of the large gear 17, as shown in FIG. 4. When the large gear 17 is rotated, two agitator members 9 and 9 are rotated according to a rotation of the large gear 17 and can agitate capsule toys 2.

Therefore, when the coin sorting handle 5 is rotated, the gear 10 which is fixed to the handle shaft 5*a* of the coin sorting handle 5 is rotated, and the gear 12 which is engaged with the gear 10 is also rotated. Thereby, when the gear 13 which is biased against the gear 12 is rotated, the gear 70 which is engaged with the gear 13 is rotated, and the coin turn table 7 which fixes the gear 70 is also rotated.

Two protruding portions 7*a* and 7*a* of the coin turn table 7 is fitted in the two holes 8*a* and 8*a* of the toy discharging drum 8, respectively. Therefore, the toy discharging drum 8 is rotated and the gear 15 which is formed at the toy discharging drum 8 is also rotated. Thereby, the gear 16 which is engaged with the gear 15 is rotated, and the large gear 17 which is engaged with the gear 16 is also rotated.

Therefore, when the coin sorting handle 5 is rotated, two agitator members 9 and 9 which are provided at the large gear 17 are rotated according to a rotation of the large gear 17 and can agitate capsule toys 2.

Hereinafter, the coin sorting device incorporating the coin turn table 7 will be explained with reference to FIG. 5 to FIG. 8, as follows.

Figure 5:
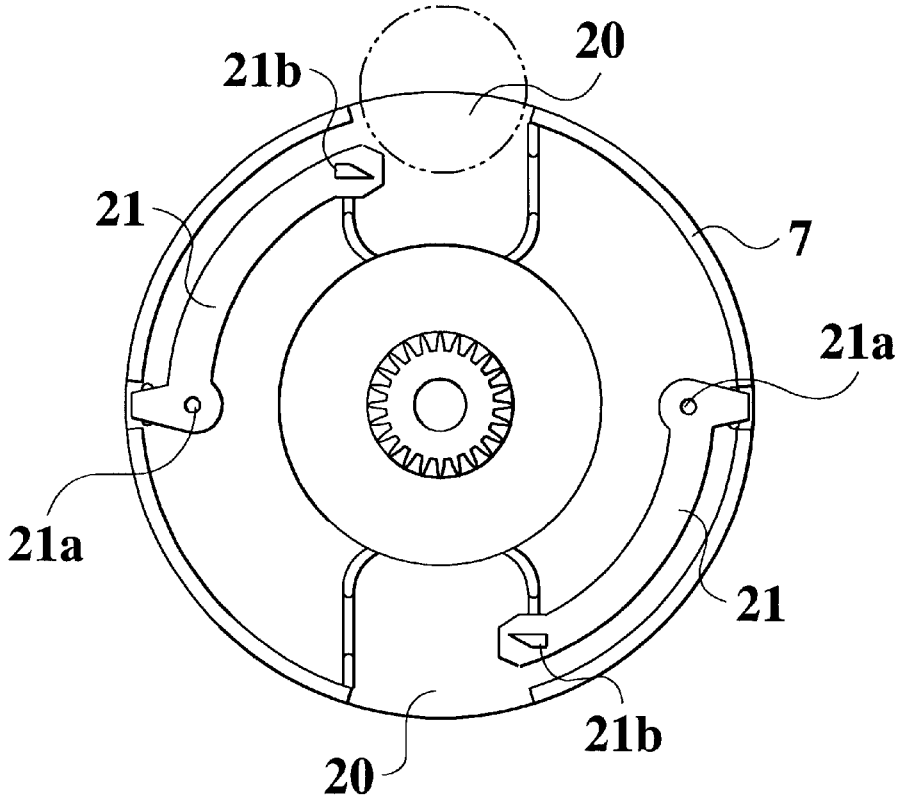
FIG. 5 is a front view of the coin turn table of the automatic vending machine toy.
Figure 6:
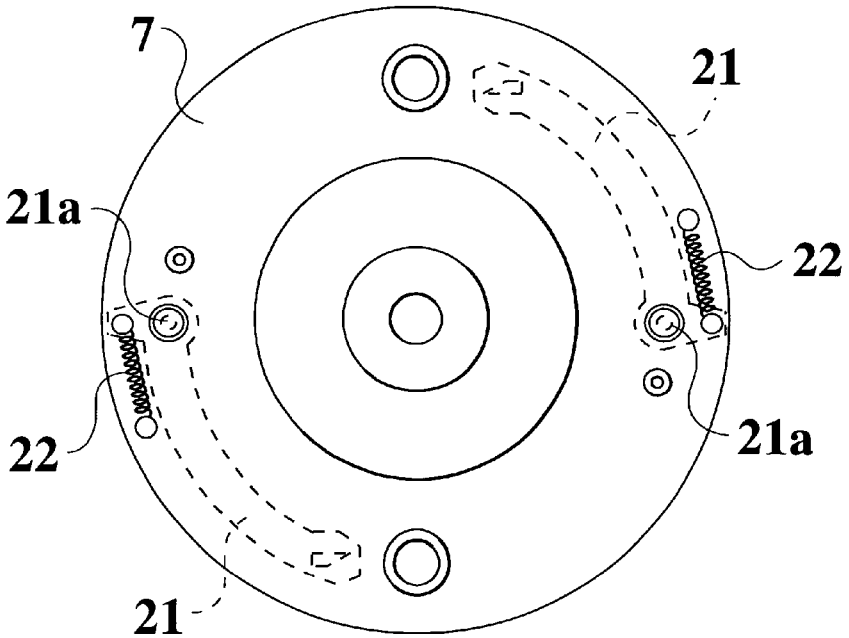
FIG. 6 is a rear view of the coin turn table of the automatic vending machine toy.
Figure 7:
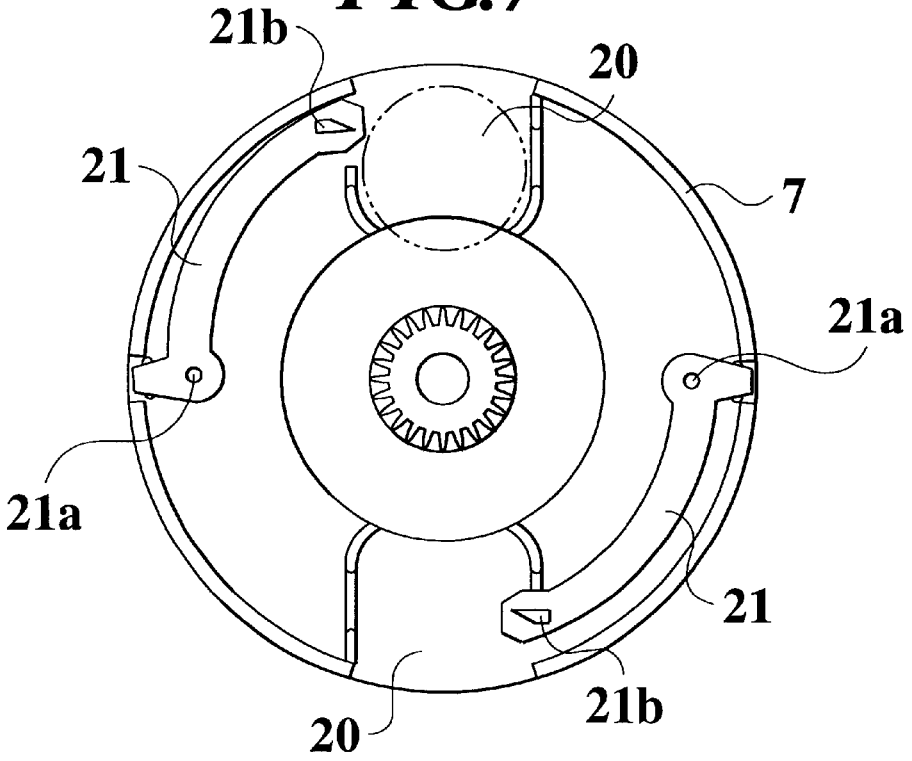
FIG. 7 is a front view of the coin turn table of the automatic vending machine toy.
Figure 8:
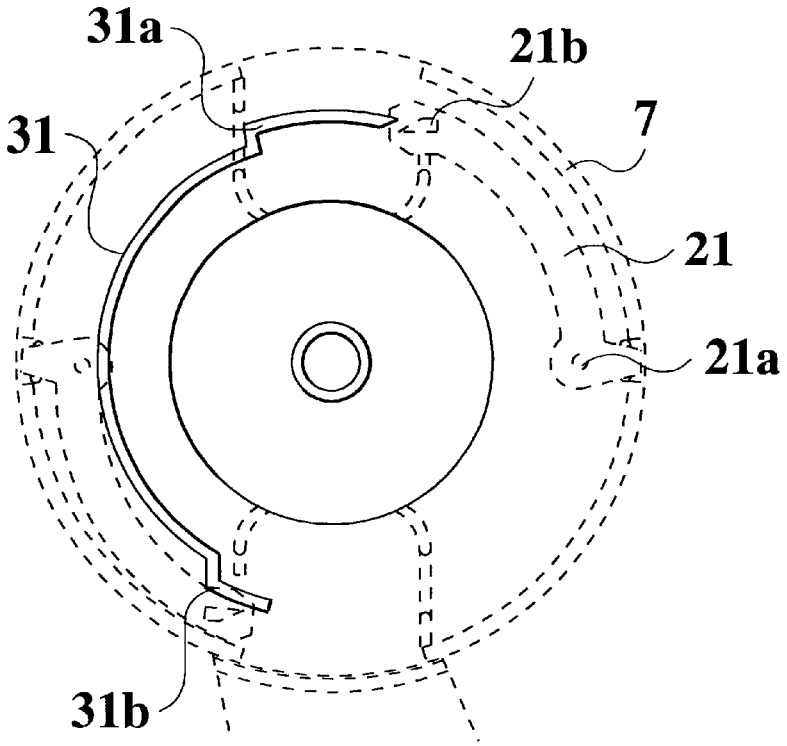
FIG. 8 is a rear view of the coin turn table of the automatic vending machine toy.

FIG. 5 is a front view of the coin turn table 7 of the automatic vending machine toy 1. FIG. 6 is a rear view of the coin turn table 7 of the automatic vending machine toy 1 as shown in FIG. 5. FIG. 7 is a front view of the coin turn table 7 of the automatic vending machine toy 1. FIG. 8 is a rear view of the coin turn table 7 of the automatic vending machine toy 1 as shown in FIG. 7.

The coin sorting device incorporating the coin turn table 7 is composed of two coin receiving portions 20 and 20, two rocking members 21 and 21, two shafts 21*a* and 21*a* of the rocking members 21 and 21, two contact portions 21*b* and 21*b* on the rocking members 21 and 21, two pulling springs 22 and 22 for the rocking members 21 and 21, and so on.

The two coin receiving portions 20 and 20 are formed by partitions on a front surface of the coin turn table 7, as shown in FIG. 5.

Each rocking member 21 is provided near each coin receiving portion 20. At one top end portion of the rocking member 21, the shaft 21*a* and the pulling spring 22 are provided, and the rocking member 21 is rocked on the shaft 21*a*. At another top end portion of the rocking member 21, the contact portion 21*b* having a triangle shape is formed.

One top end portion at which the shaft 21*a* is provided, of the rocking member 21 provides the pulling spring 22, thereby another top end portion of the rocking member 21 is biased by the pulling spring 22 against a periphery of a coin which is received by the coin receiving portion 20, as shown in FIG. 6.

Another top end portion at which the contact portion 21*b* is formed, of the rocking member 21 is extended to an inside of the coin receiving portion 20 corresponding to each rocking member 21. The top end portion is stopped at a predetermined position by means of one side portion on the partition which forms the coin receiving portion 20. Further, the top end portion has a predetermined shape. According to the top end portion having such a shape, when a coin having a normal size is put in the coin put-in port 4 and received in the coin receiving portion 20, the top end portion is sliding contacted with the received coin by the pulling spring 22. Thereby, the top end portion gets out in a radial outer direction of the coin turn table 7, as shown in FIG. 7.

A frame of the automatic vending machine toy 1 is composed of a front frame 30*a* and a back frame 30*b*, as shown in FIG. 4.

A convex portion 31 having a band-like shape is provided in an inside of the front frame 30*a*, as shown in FIG. 8.

One end portion 31*a* of the convex portion 31 having the band-like shape is provided near the coin put-in port 4 and one coin receiving portion 20. Another end portion 31*b* of the convex portion 31 is provided near another coin receiving portion 20.

While the top end portion at which the contact portion 21*b* is formed, of the rocking member 21 stops at the predetermined position, one end portion 31*a* of the convex portion 31 is hit against the contact portion 21*b* of the rocking member 21. That is, when a smaller coin than a normal coin is put in the coin receiving portion 20 of the coin turn table 7, the rocking member 21 is not rocked. Therefore, the top end portion at which the contact portion 21*b* is formed, of the rocking member 21 stops at the predetermined position so that the contact portion 21*b* of the rocking member 21 is hit against one end portion 31*a* of the convex portion 31. Thereby, a rotation of the coin turn table 7 is prevented by one end portion 31*a* of the convex portion 31.

On the other hand, while the top end portion at which the contact portion 21*b* is formed, of the rocking member 21 does not stop at the predetermined position, one end portion 31*a* of the convex portion 31 is not hit against the contact portion 21*b* of the rocking member 21. That is, when a coin having a normal size is put in the coin receiving portion 20 of the coin turn table 7, the rocking member 21 is rocked. Therefore, the top end portion at which the contact portion 21*b* is formed, of the rocking member 21 gets out in a radial outer direction of the coin turn table 7 so that the contact portion 21*b* of the rocking member 21 is not hit against one end portion 31*a* of the portion 31. Thereby, the rotation of the coin turn table 7 is not prevented and is allowed by one end portion 31*a* of the convex portion 31.

Another end portion 31*b* of the convex portion 31 has a bending shape. According another end portion 31*b* having the bending shape, of the convex portion 31, the top end portion at which the contact portion 21*b* is formed, of the rocking member 21 is got out in a radial outer direction of the coin turn table 7, at a coin take-out position. Thereby, a put-in coin is fallen down at the coin take-out position.

A coin path part 40 will be explained with reference to FIG. 4. The coin path part 40 forms a coin path 41 between the front frame 30*a* and the coin path part 40. A coin fallen down from the coin turn table 7, passes through the coin path 41 and falls in a lower side of the coin path part 40. The coin fallen in the lower side of the coin path part 40 can be taken out when a coin take-out door which is provided at the back frame 30*b* and not shown in figures, is opened.

Capsule receiving plates 50 and 51 will be explained with reference to FIG. 4. The capsule receiving plate 50 receives a capsule toy 2 and passes the capsule toy 2 to the toy discharging drum 8. The capsule receiving plate 51 discharges the capsule toy 2 from the toy discharging drum 8 to a toy take-out port.

A clear plate 60 will be explained with reference to FIG. 4. Through the clear plate 60, internal capsule toys 2 can be seen.

The toy discharging drum 8 is composed of drum pieces 80*a* and 80*b*.

A pawl portion 90 is engaged with the gear 15 which is provided at the rear side of the toy discharging drum 8, and prevents the toy discharging drum 8 from rotating backward.

Although the present invention has been explained according to the above-described embodiment, it should also be understood that the present invention is not limited to the embodiment and various changes and modifications may be made to the invention without departing from the gist thereof.

For example, although the rocking member 21 is attached to a side of the coin turn table 7 and the convex portion 31 as a stopper is attached to a side of the front frame 30*a*, in the above-described embodiment, the rocking member 21 may be attached to the side of the front frame 30*a* and the convex portion 31 as the stopper may be attached to the side of the coin turn table 7.

Further, although two coin receiving portions 20 and 20 are arranged at opposite positions each other on the coin turn table 7, and two rocking members 21 and 21 are arranged on the coin turn table 7 according to the coin receiving portions 20 and 20, respectively, in the above-described embodiment, more coin receiving portions may be arranged on the coin turn table 7 and more rocking members may be arranged on the coin turn table 7 according to the coin receiving portions, respectively.

Further, when the rocking member 21 is attached to the side of the front frame 30*a* and the convex portion 31 is attached to the side of the coin turn table 7 as well, more coin receiving portions may be arranged on the coin turn table 7 and more convex portions may be arranged on the coin turn table 7 according to the coin receiving portions, respectively.

Further, although the rocking member 21 is biased by the pulling spring 22 so that the top end portion thereof is biased against the periphery of the coin, in the above-described embodiment, the rocking member 21 may be biased by another biasing member.

Further, although two agitator members 9 and 9 are provided at the front side surface of the large gear 17, in the above-described embodiment, more agitator members may be provided at the large gear 17.

Further, the present invention may have a switch for turning on by the rotation of the coin turn table 7, to start a game when turning the switch on.

Further, the present invention may have a spring for winding by the rotation of the coin turn table 7, to start a game by a power of the spring.

The entire disclosure of Japanese Patent Application No. Tokugan hei-11-48772 filed on Feb. 25, 1999 including specification, claims, drawings and summary are incorporated herein by reference in its entirety.

According to the present invention, a main effect will be explained, as follows.

The coin sorting device comprises: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion.

According to the coin sorting device, it is possible to have a more simple structure and easily discriminate whether a coin is a normal coin or not.

What is claimed is:

1. A coin sorting device comprising:

a body;

a coin put-in port for putting a coin in;

a coin sorting handle which can be rotated;

a coin turn table which can be rotated according to a rotation of the coin sorting handle and comprises a coin receiving portion for receiving a put-in coin;

a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion.

2. A coin sorting device as claimed in claim 1, wherein a plurality of coin receiving portions are arranged with approximately the same intervals, along a periphery of the coin turn table, and a plurality of rocking members are arranged on the coin turn table according to the coin receiving portions.

3. A coin sorting device as claimed in claim 1, wherein the rocking member is biased by a biasing member so that the top end portion thereof is biased against a periphery of a normal coin which is received by the coin receiving portion.

4. A commodity discharging device which can contain many commodities comprising:

a coin sorting device comprising: a body; a coin put-in port for putting a coin in; a coin sorting handle which can be rotated; a coin turn table which can be rotated according to a rotation of the coin sorting handle and comprises a coin receiving portion for receiving a put-in coin; a rocking member which can rock around a shaft which is attached to the coin turn table, for rocking so that a top end portion of the rocking member is pressed to move in a radial outer direction by a periphery of a normal coin which is received by the coin receiving portion; and a stopper which is attached to the body, for preventing a rotation of the coin turn table by hitting the top end portion of the rocking member against an end portion of the stopper when a normal coin is not received by the coin receiving portion, while for allowing the rotation of the coin turn table without hitting the top end portion of the rocking member which is pressed to move in the radial outer direction, against the end portion of the stopper when a normal coin is received by the coin receiving portion, and a structure for discharging a commodity according to a rotation of the coin turn table.

5. A commodity discharging device as claimed in claim 4, further comprising a commodity discharging drum for discharging a commodity by rotating with the coin turn table as one.

6. A commodity discharging device as claimed in claim 4, further comprising an agitator member for agitating commodities according to a rotation of the coin turn table.

* * * * *